US006901755B2

(12) United States Patent
Corey et al.

(10) Patent No.: US 6,901,755 B2
(45) Date of Patent: Jun. 7, 2005

(54) PISTON POSITION DRIFT CONTROL FOR FREE-PISTON DEVICE

(75) Inventors: John A. Corey, Melrose, NY (US); Philip S. Spoor, Waterford, NY (US)

(73) Assignee: Praxair Technology, Inc., Danbury, CT (US)

( * ) Notice: Subject to any disclaimer, the term of this patent is extended or adjusted under 35 U.S.C. 154(b) by 189 days.

(21) Appl. No.: 10/298,566

(22) Filed: Nov. 19, 2002

(65) Prior Publication Data

US 2003/0183074 A1 Oct. 2, 2003

Related U.S. Application Data

(60) Provisional application No. 60/368,948, filed on Mar. 29, 2002.

(51) Int. Cl.[7] ..... F01B 29/00

(52) U.S. Cl. ..... 60/520; 123/46 R

(58) Field of Search ..... 60/517, 520, 494, 60/522; 92/82; 123/46 R; 91/490

(56) References Cited

U.S. PATENT DOCUMENTS

| | | | | |
|---|---|---|---|---|
| 5,295,355 A | | 3/1994 | Zhou et al. | 62/6 |
| 5,461,859 A | * | 10/1995 | Beale et al. | 60/520 |
| 5,813,234 A | | 9/1998 | Wighard | 62/6 |
| 5,873,246 A | * | 2/1999 | Beale | 60/520 |
| 5,901,556 A | | 5/1999 | Hofler | 62/6 |
| 5,904,046 A | | 5/1999 | Kawano | 62/6 |
| 6,079,960 A | | 6/2000 | Funatsu et al. | 417/488 |
| 6,209,328 B1 | | 4/2001 | Kim et al. | 62/6 |
| 6,564,552 B1 | * | 5/2003 | Ward et al. | 60/520 |

FOREIGN PATENT DOCUMENTS

JP 09242903 A * 9/1997 ..... F16K/15/02

* cited by examiner

*Primary Examiner*—Thomas E. Lazo
(74) *Attorney, Agent, or Firm*—Stanley Ktorides

(57) ABSTRACT

A piston position drift control for a free-piston device. The control includes a passage connecting internal volumes of the device, the passage being substantially shorter than an acoustic wavelength of the device; and a check valve in the passage for controlling fluid communication between the internal volumes, the check valve having an opening pressure not less than approximately 20% of a maximum pressure differential of the device at a maximum stroke. The control is passive, requires no active control once in service, provides low susceptibility to damage or fouling, and is amenable to adjustment or repair if needed. In addition, the control is small and inexpensive, and functions across the entire operational range of a free-piston device it supports. A related free-piston device including the piston position drift control is also provided.

17 Claims, 3 Drawing Sheets

PISTON POSITION DRIFT CONTROL FOR FREE-PISTON DEVICE

CROSS REFERENCE TO RELATED APPLICATIONS

This application claims the benefit of provisional application Ser. No. 60/368,948, filed Mar. 29, 2002.

TECHNICAL FIELD

The present invention relates generally to piston position drift control for a free-piston device, and more particularly, to a passive piston position drift control using a check valve and a related free-piston device

BACKGROUND ART

Direct conversion of alternating current (AC) electric power into reciprocating mechanical power by resonant motors, and the reverse conversion in alternators, has become important in applications like pulse-tube and Stirling-cycle cryocoolers and small externally-heated engine-generators operating on a thermoacoustic or Stirling cycle. Unlike more common rotary motors, the moving parts in such devices reciprocate, typically along the central axis of the assembly. The movement is typically guided with non-contacting bearings or non-rubbing flexures, enabling use of non-contacting and non-wearing close-clearance seals between pistons and cylinders. Such seals, though fully capable of adequately impeding alternating flow at operating frequency, nonetheless can allow one-way flow (leakage) if a suitable pressure difference arises across the seal. In practice, these pressure leakages arise due to geometric anomalies or asymmetric pressure-position relationships. Leakage leads to accumulation of excess gas on one side of the piston that pushes the piston toward the depleted side in a phenomenon called "drift." Uncorrected drift leads the piston to move to the end of its allowed travel, limiting or preventing further reciprocation. The tendency to drift is proportional to the amplitude of the pressure wave in the device, which is a stronger-than-proportional function of the piston stroke. As a result, drift occurs minimally at low strokes, but becomes a severe problem at higher strokes.

In past practice, especially in free-piston Stirling engines, a feature called a "centerport" has been used to address leakage and piston mis-positioning. A centerport is a set of aligned ports in both the cylinder and moving piston of a free-piston device. The ports align when the piston is near its intended mid-stroke position. That position-dependent alignment of ports creates a momentary short-circuit or bypass of the piston seal. When the piston is not at its intended midstroke position, the ports are effectively blocked off or closed by the close fit of the piston clearance seal. For devices where the mean pressure and mean position are coincident in time, this arrangement provides a robust, passive correction for any drift that causes unequal pressure during port alignment. In this case, the undesired pressure difference drives a corrective gas flow. However, centerports are not ideal for all situations. For instance, they do not work well if there is a significant phase angle between pressure and motion, i.e. when a substantial pressure difference exists at the times when there is port alignment (in a centered piston position). In this case, the otherwise corrective flow of the centerport leads to a wasteful flow loss at the ports. Unfortunately, a large class of commercially significant machines exhibit such a phase shift, making centerport systems too inefficient for use with these machines.

Centerports also create at least some minimum, unavoidable loss for low-phase devices (e.g., free-piston Stirling engines) since there is always some phase difference. In addition, the required ports for low-phase devices are typically very small, precise orifices to avoid over-correction. These small orifices are susceptible to clogging, as well as being costly to manufacture. Centerports are also completely contained within the deepest parts of the free-piston device, which requires costly disassembly and/or part replacement if a malfunction occurs. Further, even without a discrete malfunction, there is no mechanism for adjusting centerports while in service to compensate for changing conditions in the seal or drift.

Another piston position or drift control practice provides an external circuit around the piston seal and at least one control valve in the circuit. Sensing means are employed to detect piston position. The piston position data is used, through a microprocessor control, to momentarily open the control valve to enable corrective flow when excess piston drift is detected. Often two active control valves are used in parallel in a network with a check valve before or after each control valve. In this case, each control valve is used to provide corrective flow in just one direction. This simplifies control algorithms and reduces the required duty cycle for the control valves. Such systems work well, but require extensive external, pressurized piping and valves, as well as costly position sensors and a controller. Such active systems are easily repaired, easily adjusted, and adapt without further intervention to changing conditions of seal flow and drift. However, the external plumbing is more susceptible to leakage and damage, and the increased complexity implies lower reliability.

Another piston position or drift control practice provides a tuned acoustic waveguide bypass around the piston seal, presenting high alternating flow impedance (and therefore little loss on the seal function), but low unidirectional flow impedance (therefore presenting little restriction to corrective flow that keeps mean pressures equal across the piston seal). An acoustic bypass can be built internally or externally, and consists of a long, narrow passage (e.g., a tube) between internal volumes of the device. The length of the bypass is many times its flow area and ideally substantially equal to a one-half wavelength (or multiple thereof) of the free-propagation of sound in the sealed medium of the device at the frequency of piston reciprocation. This type bypass is passive like centerports, but without the complex, precision machining required for centerports. However, the acoustic bypass is sensitive to operating frequency. In addition, an acoustic bypass is difficult to apply efficiently due to actual gas flow losses near the ends of the tube unless the drift to be corrected is very slight. Accordingly, this practice is generally suitable only for devices with extremely good seals or little penalty for lower efficiency.

In view of the foregoing, there is a need in the art for an improved piston position drift control and a related free-piston device using the same

SUMMARY OF THE INVENTION

The invention according to the following aspects provides a piston position drift control that is passive, requires no active control once in service, provides low susceptibility to damage or fouling, and is amenable to adjustment or repair if needed. In addition, the control is small and inexpensive, and functions across the entire operational range of a free-piston device it supports. A related free-piston device including the piston position drift control is also provided.

A first aspect of the invention provides a piston position drift control for a free-piston device having a reciprocating piston with an imperfect seal between internal volumes adjacent to the piston, the control comprising: a passage connecting the internal volumes, the passage being substantially shorter than an acoustic wavelength of the device; and a check valve in the passage for controlling fluid communication between the internal volumes, the check valve having an opening pressure not less than approximately 20% of a maximum pressure differential of the device at a maximum stroke.

A second aspect of the invention is directed to a free-piston device comprising: a reciprocating piston with an imperfect seal between internal volumes adjacent to the piston; a piston position drift control including a passage, between the internal volumes, that is substantially shorter than an acoustic wavelength of the device; and a check valve in the passage for controlling fluid communication between the internal volumes, the check valve having an opening pressure not less than approximately 20% of a maximum pressure differential of the device at a maximum stroke.

A third aspect of the invention includes a piston position drift control for a free-piston device having a reciprocating piston with an imperfect seal between internal volumes adjacent to the piston, the control comprising: means for connecting the internal volumes; and means for passively allowing fluid communication between the internal volumes when a pressure differential between the internal volumes is not less than approximately 20% of a maximum pressure differential of the device at a maximum stroke.

The foregoing and other features of the invention will be apparent from the following more particular description of embodiments of the invention.

BRIEF DESCRIPTION OF THE DRAWINGS

The embodiments of this invention will be described in detail, with reference to the following figures, wherein like designations denote like elements, and wherein.

DETAILED DESCRIPTION

Figure 1:
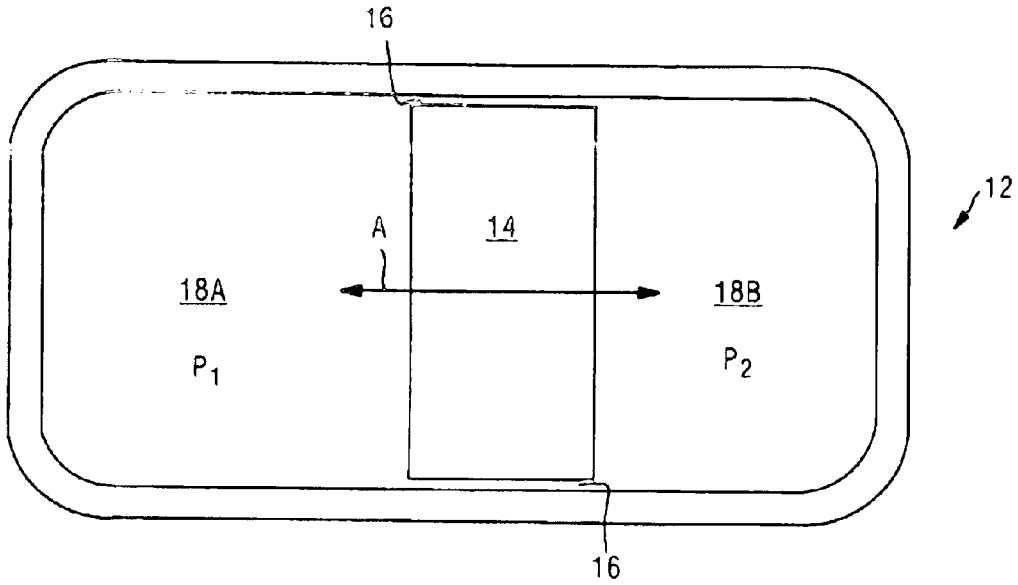
FIG. 1 PRIOR ART
FIG. 1 shows a schematic representation of a prior art free-piston device.

Referring to FIG. 1, a conventional free-piston device 12 includes a reciprocating piston 14 with a seal 16 between internal volumes 18A and 18B adjacent to piston 14. The reciprocating motion of piston 14 is indicated by arrow A. In free-piston devices 12, a pressure wave is created (by structure not shown) in at least one internal volume 18A, 18B. Such pressure waves give rise to time-variant pressure differences (i.e., times when $P_1$ does not equal $P_2$) across seal 16 that drive leakage flows alternating back and forth across seal 16. Typically, such pressure differences are cyclic and reversing. Under certain conditions, a net leakage flow in one direction across seal 16 can occur. Factors that contribute to these conditions may include, for example, overall operating conditions, seal geometries, and phase relationships between the pressure wave and the motion. A leakage flow that tends to accumulate fluid on one side of piston 14 pushes the average position of piston 14 away from that accumulation, in a phenomenon known as 'piston drift'. If uncorrected, such drift can damage or destroy a piston or any suspension (not shown) that supports it. In addition, mechanical limits for piston motion in a device combine with any drift in mean position to reduce the available stroke of the piston, reducing the achievable output capacity of the device.

Figure 2:
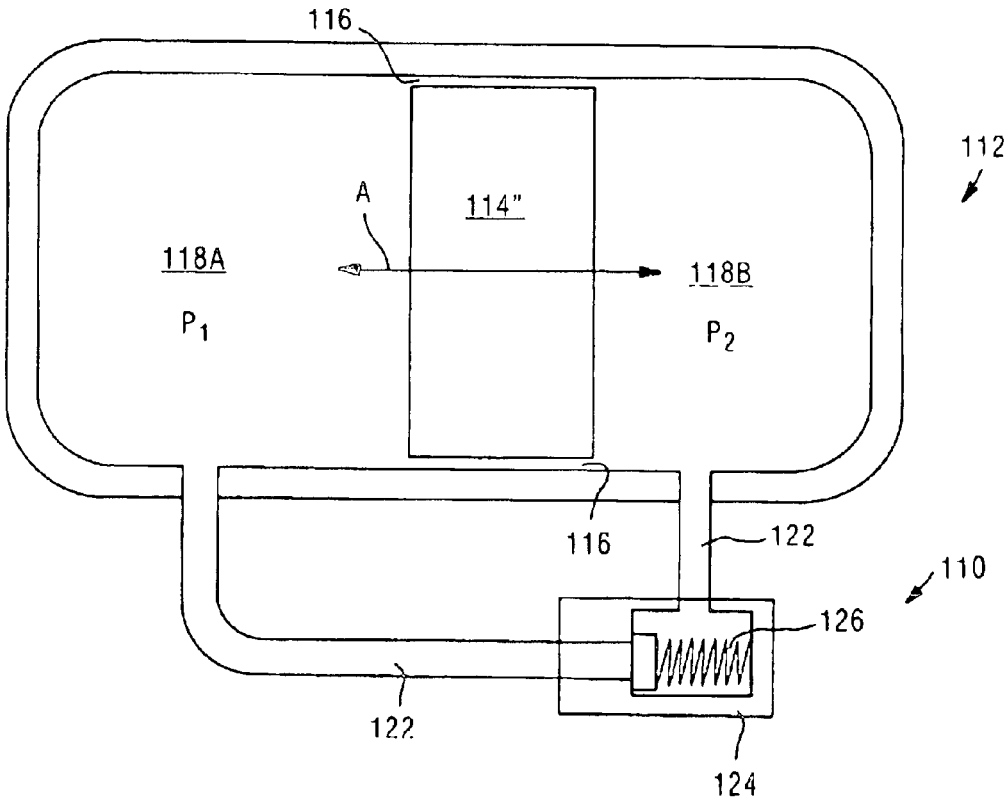
FIG. 2 shows a schematic representation of a free-piston device having a piston position drift control according to the invention.

Referring to FIG. 2, the invention provides a piston position drift control 110 for a free-piston device 112. Device 112 includes a reciprocating piston 114 with an imperfect seal 116 between internal volumes 118A and 118B adjacent to piston 114. Device 112 can be any now known or later developed free-piston device used in applications such as compressors, pulse-tube and Stirling-cycle cryocoolers, or engine-generators operating on a thermoacoustic or Stirling cycle, etc. The reciprocating motion of piston 114 is indicated by arrow A. Piston position drift control 110 includes a passage 122 connecting internal volumes 118A, 118B and a check valve 124. A check valve is a valve that is biased, e.g. by a spring 126, against opening. An "opening pressure" is a pressure sufficient to overcome the bias and open or crack the valve seal, thus allowing flow therethrough in a preferred direction. Pressure difference in the opposite direction only further clamps the valve in the closed position. Passage 122 is substantially shorter than an acoustic wavelength of device 112 to eliminate acoustic phase shifting issues at valve 124 and/or piston seal 116. Passage 122 does not necessarily have to be close-coupled to seal 116 as with centerports, nor mostly external as with tubular acoustic bypass systems. Check valve 124 is positioned in passage 122 for controlling fluid communication between internal volumes 118A, 118B. Check valve 124 allows flow in a direction that corrects for leakage across imperfect seal 116.

Figure 3:
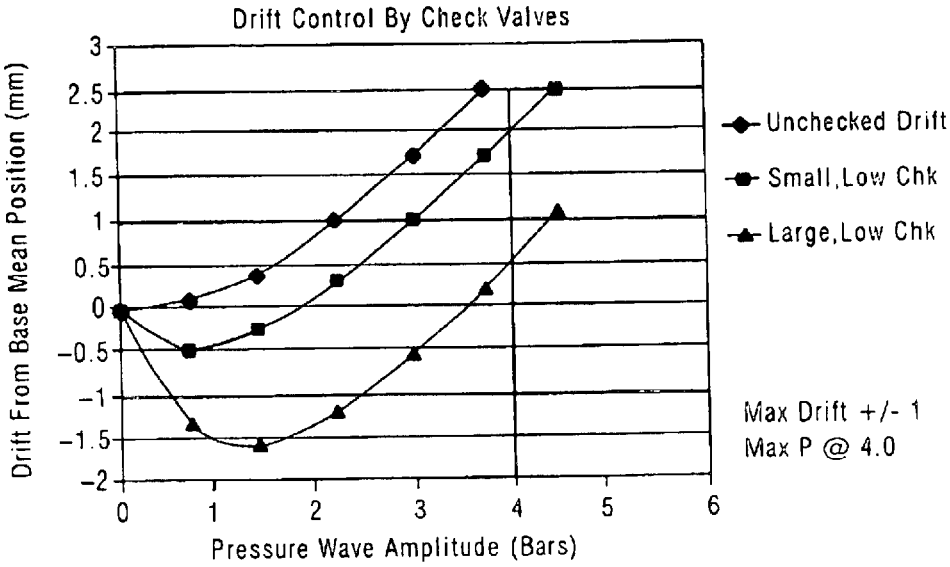
FIG. 3 shows a graphical representation of pressure wave amplitude versus piston drift using no correction and various piston position drift control check valves.

Referring to FIG. 3, a graphical representation of pressure wave amplitude (horizontal axis) versus piston drift (vertical axis) in a variety of situations is shown. It should be recognized that the particular pressure wave amplitude and drift, shown and discussed below, are particular to a specific machine and that the values will vary depending on a number of variables such as device size, seal configuration, etc. In this particular example, an acceptable range of piston drift is +/−1 mm (indicated by the thicker horizontal graph lines).

In FIG. 3, operation of a free-piston device with uncorrected drift is indicated by the line with the diamond indicia. As illustrated, a net leakage flow linearly forces the piston to an extreme drift, e.g., 2.5 mm from the mean position at less than 4 bar pressure wave amplitude. Operation of a piston position drift control, such as shown in FIG. 2, having a small, low opening pressure check valve is shown by the line with the square indicia. This type valve would be expected to be advantageous since at a typical operating frequency of 60 Hz, compatible with grid-supplied electricity in the USA, each cycle lasts just 15 milliseconds, of which only one half is pressure-biased in the allowable flow direction. Accordingly, a valve element that is small and light to minimize its inertial resistance to opening and closing quickly would be advantageous since the valve can pass enough preferred-direction flow during the available half-cycle and prevent adverse flow during the other half cycle. In contrast, a valve element that is too massive would be expected to never fully open or close at these frequencies, becoming just a variable resistance in the line without directional preference. Because the valve must be small, it follows that the opening pressure should be as low as possible, allowing the valve to open and remain open for the largest part of the cycle with a preferential pressure difference. Nonetheless, as shown in FIG. 3, the control using a small, low opening pressure check valve works at low and mid-range pressure wave amplitude (e.g., approximately 0 to approximately 2.5 bar), but is inadequate at high range pressure wave amplitude (e.g., greater than approximately 2.5 bar).

Operation of a large, low opening pressure check valve is indicated in FIG. 3 by the line with the triangle indicia. In this case, the control works sufficiently to correct drift at high pressure wave amplitude (e.g., greater than approximately 2.5 bar), but is excessive at a mid-range of pressure wave amplitude (e.g., approximately 1.0 bar to approximately 2.5 bar).

Figure 4:
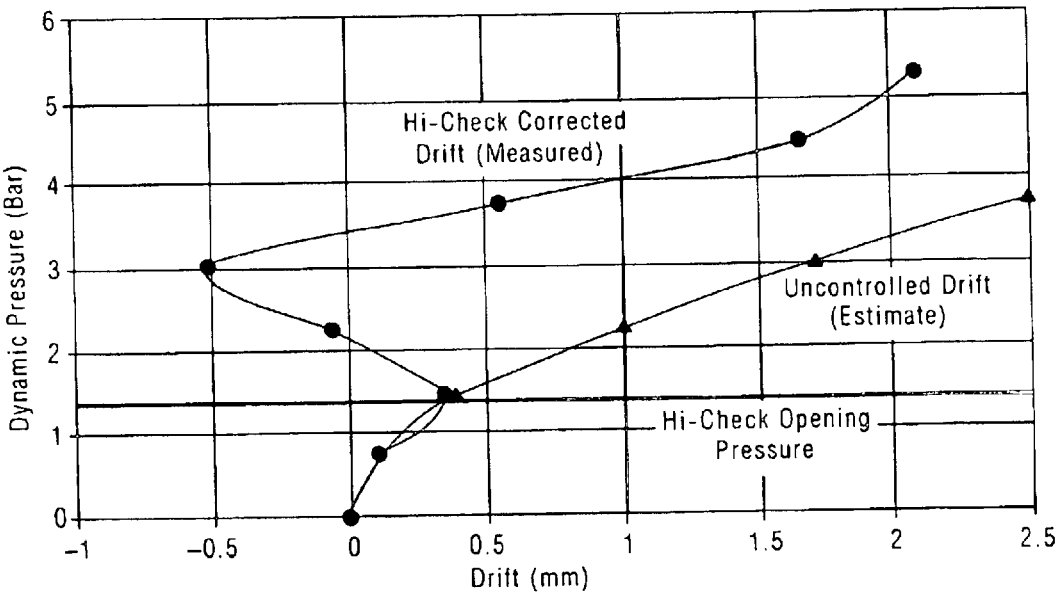
FIG. 4 shows a graphical representation of pressure wave amplitude versus piston drift using a piston position drift control according to the invention.

In view of the foregoing, check valve 124 has been chosen such that it is a larger, higher opening pressure valve. In particular, a check valve 124 has a high flow rating (i.e., capacity), but is not opening at a low range of piston stroke for a given device 112. As shown in the graph of FIG. 4 by the line with circle indicia (note: graph axes are switched from that of FIG. 3), such a valve ignores low pressure wave amplitude drift, then over-corrects (within limits) in mid-range, allowing further under corrected high-range drift to accumulate but still remain within drift limits. In operation, a check valve 124 that does not open at low pressure wave amplitude, despite initial drift, but then opens wide is sufficient to push piston 114 towards its opposite, over-corrected limit at a mid-range stroke level (e.g., in this case approximately 0.5 to approximately 2.5 bar). The opening pressure level in this case may be approximately 1.3 bar or 20 psi. From the opening pressure level, further increases in drift with increases in stroke are only slightly resisted by the added flow through the fully-open large valve as pressure wave amplitude increases. However, since the drift begins from the far opposite limit, maximum stroke can be achieved before the drift is excessive in the first direction. The result is that the entire operating range exhibits drift within predefined acceptable limits (i.e., +/−1 mm in this case), but with minimal corrective flow rates and associated energy losses.

Figure 5:
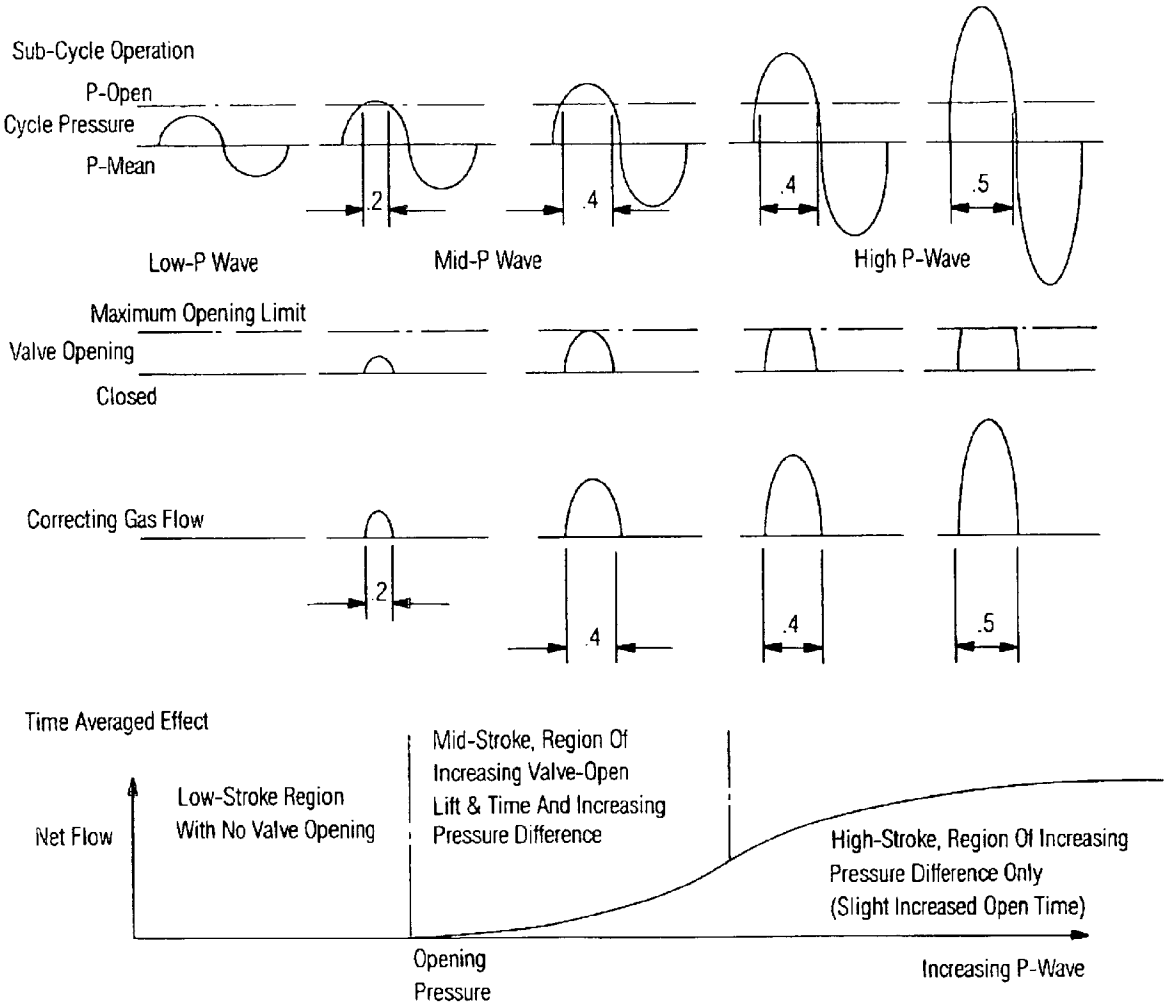
FIG. 5 shows a side-by-side graphical representation of pressure wave amplitude, valve opening and flow through the valve.

FIG. 5 shows a side-by-side comparison of pressure wave amplitude, valve opening, correcting gas flow through the valve during sub-cycle operation. In addition, a time averaged effect on net flow through the valve is shown. Collectively, the above functionality can be stated as: valve 124 is not opening at an approximate low-range of piston stroke, increasingly opening in an approximate mid-range of piston stroke, and opening fully in an approximate high range of piston stroke. As illustrated in FIG. 5, valve 124 allows increasing flow in the approximate mid-range of piston stroke due to increasing opening of the valve for longer durations of each cycle (e.g., approximately 20%–40% of the cycle of the pressure wave). Valve 124 allows increasing flow in the approximate high range of piston stroke mainly due to increasing pressure differential (and the valve being open for slightly longer durations of each cycle e.g., approximately 50% of the cycle of the pressure wave). As shown in the "time averaged effect," however, net flow increase flattens with increasing pressure wave amplitude in the high range of piston stroke compared to the more rapid net flow increases in the mid-range of piston stroke.

The feasibility of this arrangement can be traced to the fact that the pressure wave amplitude and drift tendency increase as a superlinear function of stroke in a typical free-piston device, but the flow through a check valve, once open fully, increases approximately linearly with increasing stroke. As a result, if the valve is large enough to keep drift within acceptable limits at full stroke, a higher opening pressure valve is more desirable.

In accordance with the above explanation, in one embodiment, a check valve 124 is provided that has a high flow rating but that is not opening at a low-range of piston stroke, and has an opening, pressure not less than approximately 20% of a maximum pressure differential (i.e., $P_2-P_1$) of device 12 at a maximum stroke. On the other end, the opening pressure may be set to not be greater than approximately 50% of the maximum pressure differential of the device at the maximum stroke. For the example used above, the opening pressure is approximately 1.3 bar or 20 psi. Further, a maximum pressure differential may be approximately 4.9 bar or 75 psi.

As an alternative, a restrictor orifice (not shown) that can be adjusted or set to match the conditions of a specific device's drift behavior may also be provided in passage 122. This orifice may be used to reduce the size of the valve (i.e., reduce its flow rating).

The above-described piston position drift control 110, compared to uncorrected drift, nearly doubles the usable pressure wave amplitude attainable within the limits of acceptable drift (e.g., +/−1 mm). Control 110 is passive, requires no active control once in service, provides low susceptibility to damage or fouling, and is amenable to adjustment or repair if needed. In addition, the control is small and inexpensive, and functions across the entire operational range of a free-piston device it supports. As a result, the control provides higher efficiency and robust drift control in free-piston devices enabling, use of a greater portion of the stroke capacity. In addition, control 110 eliminates the need for conventional complex or costly drift control alternatives.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

What is claimed is:

1. A piston position drift control for a free-piston device having a reciprocating piston with an imperfect seal between internal volumes adjacent to the piston, the control comprising:

a passage connecting the internal volumes, the passage being substantially shorter than an acoustic wavelength of the device; and a check valve in the passage for controlling fluid communication between the internal volumes, the check valve having an opening pressure not less than approximately 20% of a maximum pressure differential of the device at a maximum stroke.

2. The piston position drift control of claim 1, wherein the opening pressure is not greater than approximately 50% of the maximum pressure differential of the device at the maximum stroke.

3. The piston position drift control of claim 1, wherein the opening pressure is approximately 20 psi.

4. The piston position drift control of claim 1, wherein the piston position is regulated in a range of +/−1 mm from a mean average position.

5. The piston position drift control of claim 1, wherein the maximum pressure differential is approximately 75 psi.

6. The piston position drift control of claim 1, wherein a flow rating of the check valve is such that the valve is not opening at an approximate low-range of piston stroke, increasingly opening in an approximate mid-range of piston stroke, and opening fully in an approximate high range of piston stroke.

7. The piston position drift control of claim 6, wherein the valve allows increasing flow in the approximate mid-range of piston stroke due to increasing opening of the valve and in the approximate high range of piston stroke due to increasing pressure differential.

8. The piston position drift control of claim 1, wherein the check valve allows flow in a direction that corrects for leakage across the imperfect seal.

9. A free-piston device comprising:

a reciprocating piston with an imperfect seal between internal volumes adjacent to the piston;

a piston position drift control including a passage, between the internal volumes, that is substantially shorter than an acoustic wavelength of the device; and a check valve in the passage for controlling fluid communication between the internal volumes, the check valve having an opening pressure not less than approximately 20% of a maximum pressure differential of the device at a maximum stroke.

10. The free-piston device of claim 9, wherein the opening pressure is not greater than approximately 50% of the maximum operating pressure of the device at the maximum stroke.

11. The free-piston device of claim 9, wherein the opening pressure is approximately 20 psi.

12. The free-piston device of claim 9, wherein the piston position is regulated in a range of +/−1 mm from a mean average position.

13. The free-piston device of claim 9, wherein the maximum pressure differential is approximately 75 psi.

14. The free-piston device of claim 9, wherein a flow rating of the check valve is such that the valve is not opening at an approximate low-range of piston stroke, increasingly opening in an approximate mid-range of piston stroke, and opening fully in an approximate high range of piston stroke.

15. The free-piston device of claim 14, wherein the valve allows increasing flow in the approximate mid-range of piston stroke due to increasing opening of the valve and in the approximate high range of piston stroke due to increasing pressure differential.

16. The free-piston device of claim 9, wherein the check valve allows flow in a direction that corrects for leakage across the imperfect seal.

17. A piston position drift control for a free-piston device having a reciprocating piston with an imperfect seal between internal volumes adjacent to the piston, the control comprising:

means for connecting the internal volumes; and means for passively allowing fluid communication between the internal volumes when a pressure differential between the internal volumes is not less than approximately 20% of a maximum pressure differential of the device at a maximum stroke.

* * * * *